United States Patent [19]

Fox

[11] 4,385,661

[45] May 31, 1983

[54] DOWNHOLE STEAM GENERATOR WITH IMPROVED PREHEATING, COMBUSTION AND PROTECTION FEATURES

[75] Inventor: Ronald L. Fox, Albuquerque, N. Mex.

[73] Assignee: The United States of America as represented by the United States Department of Energy, Washington, D.C.

[21] Appl. No.: 222,855

[22] Filed: Jan. 7, 1981

[51] Int. Cl.[3] ..... E21B 43/24; F23D 13/08; F23D 13/42; F23N 5/00

[52] U.S. Cl. ..... 166/59; 166/53; 166/64; 166/65 R; 431/158; 431/215; 431/243

[58] Field of Search ..... 166/57, 59, 303, 64, 166/302, 53, 65 R, 113; 431/158, 215, 242, 243; 60/39.55, 39.25, 736

[56] References Cited

U.S. PATENT DOCUMENTS

| | | | |
|---|---|---|---|
| 1,439,560 | 12/1922 | Lee | 166/303 |
| 3,133,591 | 5/1964 | Brandon | 166/303 |
| 3,360,044 | 12/1967 | Lange | 166/57 X |
| 3,700,035 | 10/1972 | Lange | 166/57 X |
| 3,980,137 | 9/1976 | Gray | 166/303 |
| 4,077,469 | 3/1978 | Hamrick et al. | 166/59 |
| 4,159,743 | 7/1979 | Rose et al. | 166/59 |
| 4,243,098 | 1/1981 | Meeks et al. | 166/303 X |

OTHER PUBLICATIONS

Fox et al., "Analysis of the Injection of Steam into Deep Reservoirs for Recovery of Tertiary Oil", 17th Aerospace Sciences Meeting, New Orleans, LA, Jan. 1979, (SAND 79-0202).

*Primary Examiner*—Stephen J. Novosad

[57] ABSTRACT

An apparatus for generation of steam in a borehole for penetration into an earth formation wherein feedback preheater means are provided for the fuel and water before entering the combustor assembly. First, combustion gases are conducted from the combustion chamber to locations in proximity to the water and fuel supplies. Secondly, both hot combustion gases and steam are conducted from the borehole back to the water and fuel supply. The water used for conversion to steam is passed in a countercurrent manner through a plurality of annular water flow channels surrounding the combustion chamber. In this manner, the water is preheated, and the combustion chamber is cooled simultaneously, thereby minimizing thermal stresses and deterioration of the walls of the combustion chamber. The water is injected through slotted inlets along the combustion chamber wall to provide an unstable boundary layer and stripping of the water from the wall for efficient steam generation. Pressure responsive doors are provided at the steam outlet of the combustor assembly. The outlet doors and fluid flow functions may be controlled by a diagnostic/control module. The module is positioned in the water flow channel to maintain a relatively constant, controlled temperature.

13 Claims, 4 Drawing Figures

8
4
FUEL
AIR IN
$H_2O$
10
5
22b
11
1
50
49
49
51
22
12
18
23
2
2
18
17
22a
24
33
34
21
16
47
47
36
48
37
48
24
3
3
20
39
27
31
39
31
28
29
28
26
25
49a
32
32
30

DOWNHOLE STEAM GENERATOR WITH IMPROVED PREHEATING, COMBUSTION AND PROTECTION FEATURES

The U.S. Government has rights in this invention pursuant to Contract Number AT (29-1)-789 and modifications between the U.S. Department of Energy and Western Electric Company, Incorporated.

BACKGROUND OF THE INVENTION

The invention is in the area of tertiary oil recovery techniques, in particular, an improved apparatus for downhole injection of steam into boreholes.

In the art of recovering oil from earth formations, tertiary methods are increasing in their importance. Initially, oil flow from many wells is driven by the pressure due to natural gases trapped along with the liquid oil in the formation. With the passage of time, natural gas pressures decrease. When gas pressure is insufficient to drive oil to the surface, pumping methods are then employed. As time passes, pumping methods may be ineffective because the flow of oil underground out of porous formations into a well may be very slow. It is at this point that tertiary methods are sought to accelerate the flow of oil from the formation into the wall. A particularly useful tertiary method employs the injection of steam. Steam serves to heat the oil in the formation, thereby reducing its viscosity and increasing its flow rate into the well for recovery.

Methods employing downhole generation of steam within a well have proved to be particularly advantageous. The prior art discloses representative methods and apparatus.

In U.S. Pat. No. 3,456,721, Smith discloses a downhole burner for generating steam. Gaseous or liquid fuels are mixed with air and combusted in a burner with simultaneous spraying of water toward the flame. The water is sprayed from a cylindrical water jacket through a plurality of orifices. Steam is formed by the vaporization of the water as the water bombards the flame.

In U.S. Pat. No. 3,980,147, Gray discloses a downhole steam injector employing the combustion of hydrogen with oxygen to generate heat to vaporize injected water to form steam. The water moves in a single direction through an annular preheater jacket surrounding the combustion chamber, and, after being preheated, enters the combustion chamber through a plurality of grooves or passages at the top of the combustion chamber near the ignitor and the hydrogen/oxygen flame.

Hamrick et al in their related U.S. Pat. Nos. 3,982,591 and 4,078,613 disclose downhole steam generators. In the first patent, in FIG. 17, water is injected through a plurality of apertures directly into the flame in a hydrogen/oxygen combustion zone. In the second patent, in FIG. 2B, water moves through a cooling annulus in a single direction before it is injected into a mixing zone spaced below the combustion zone. The mixing zone is defined by a cylindrical wall which has a plurality of apertures through which water from the cooling annulus passes laterally into the mixing zone. A heat-resistant liner is placed along the interior of the combustion zone.

Several problems have been encountered with these prior art downhole steam generators. A particularly serious problem relates to overheating of the boundary layer adjacent the inner wall of the combustion zone. A boundary layer which is thick and of low velocity leads to deterioration of combustion chamber walls and excessive thermal conduction from the combustion zone to pre-combustion areas.

A problem prevalent with the prior art devices employing heat-resistant combustion zone liners is that the liners are not cooled adequately by adjacent heat transfer jackets through which water flows in a single direction. As a consequence, the liners cannot withstand the prolonged high temperatures of the combustion zone and undergo severe deterioration.

Problems are also encountered relative to the efficient preheating of the fuels and water used in the downhole steam generator. To explain, liquid fuels may be relatively cold at the surface prior to pumping downhole. As a result, the combustion process itself must give up heat to the liquid fuel to bring it up to combustion temperatures. Cool fuel, results in production of soot, which is undersirable because of poor energy efficiency and clogging of pores in the earth formation. Similarly, water may be relatively cold at the surface prior to pumping downhole. As a result, a considerable portion of the heat generated by the combustion process is consumed in bringing the water up to the boiling point. Thus, less energy is available for driving high enthalpy steam into the earth formation.

Conditions downhole may occasionally occur which tend to flood the combustion chamber with reservoir fluids. This occurs particularly when a temporary interruption of combustion is encountered. A need for an efficient means for isolating and protecting the combustion chamber is thus indicated.

SUMMARY OF THE INVENTION

In view of the deficiencies and inadequacies described above, it is an object of the invention to provide an apparatus for downhole steam generation which provides for efficient counterflow cooling of the combustion chamber walls and preheating of the fuel and water.

More particularly, an object of the invention is to provide an apparatus for efficiently preheating and injecting the water in the boundary layer adjacent the inner wall of the combustion zone and for providing an unstable boundary layer for more efficient stripping of the water into the hot combustion gas flow.

Another object of the invention is to provide a downhole steam generation apparatus which prevents formation of soot to reduce attandant clogging of the rock formation pores, as well as pollution.

Another object of the invention is to provide an apparatus for downhole steam generation in which the walls of the combustion zone are cooled more effectively to preclude deterioration.

An additional object of the invention is to provide an apparatus for efficiently preheating liquid fuels prior to combustion in the combustion chamber of the downhole steam generator.

A further object of the invention is to provide a downhole steam generator having unique apparatus for increasing the ability to preheat the water prior to volatilization to form steam.

Still another object of the invention is to provide an apparatus for protecting the apparatus by monitoring and diagnosing critical parameters and controlling functions such as closing doors to prevent fluids in the earth formation from flooding the combustion chamber in the event of flameout.

To achieve the foregoing and other objects and in accordance with the purposes of the present invention as described herein, an apparatus for generation of steam in a borehole for penetration into a earth formation is described including: an oxidant supply; a fuel supply; an ignitor; a water supply; and a combustor assembly having an oxidant inlet, a fuel inlet, a combustion chamber, and a conduit connected between the combustion chamber and the fuel supply for conveying hot combustion gases to the preheat locations adjacent the water and fuel supply for preheating the water and fuel prior to combustion with the oxidant. Thereby, the combustor is cooled and heated water and fuel and supplied to the combustion process, resulting in more efficient combustion and less soot formation.

In a further aspect of the present invention, in accordance with its purposes and objects, the apparatus for downhole steam generation includes a feedback conduit connected between the combustor and the water and fuel supply for conveying hot combustion gases and, in addition, steam from the borehole for preheating the water and fuel prior to combustion. The presence of steam, which has a relatively high enthalpy, increases the efficiency of fuel preheating.

In a further aspect of the invention, the apparatus for downhole steam generation includes a combustion chamber which has a steam outlet to the borehole provided with pressure responsive doors for closing and opening the outlet in response to flameout. Thus, if steam pressure at the outlet and within the borehole is suddenly reduced, the pressure responsive doors close, thereby preventing flooding of the combustion chamber by the fluid, such as water, in the borehole.

The pressure responsive doors may be controlled by mechanical devices, such as springs, or by an electromechanical actuators having a pressure transducer adjacent the steam outlet.

A diagnostic and control circuit module for the actuators is housed in the water supply. The water supply serves to cool and provide a constant operating temperature for the module.

The control module is designed to the self-contained, but is connected by means of conductors to electric power and additional information processing apparatus outside the borehole. The module may also monitor additional temperatures and pressures, as well as other parameters, to provide fine-tuned control of such functions, as fuel supply and water flow.

In a further aspect of the invention, the downhole steam generator includes a combustor assembly having counter-flow annular channels for preheating water prior to steam generation and for cooling the walls of the combustion chamber. Preferably, the wall of the combustion chamber has slots for injection of water of steam generation. The location and size of the slots provide an unstable boundary layer and provide efficient conversion of water into steam.

The combustor assembly has a cylindrical outer housing sleeve, a cylindrical inner sleeve, and the combustion chamber wall in concentric relationship with spaces therebetween. The space between the outer sleeve and the inner sleeve defines a first annular water flow channel. The space between the inner sleeve and the comubstor chamber wall defines a second annular water flow channel. A passage connects the first and second flow channels resulting in a downward and upward or counter-flow of water through the channels. The flow of water in this countercurrent manner serves three purposes: (1) more efficient cooling of the wall of the combustion chamber; (2) full preheating of the water and fuel prior to steam generation; and (3) providing a constant temperature for the entire apparatus, including the sensitive electronic control module.

By efficient cooling of the walls of the combustion of the chamber, overheating of the boundary layer adjacent the inner wall of the combustion zone is avoided thereby significantly improved steam generation. In addition, the thickness of the boundary layer adjacent the inner wall of the combustion chamber is reduced, and the velocity of the boundary layer is increased. Also, deterioration of the walls is reduced considerably or eliminated by keeping the walls cooled adequately.

By conducting heat from combustion zone walls to the water, the water is preheated and brought to near the boiling point prior to injection into the hot combustion gases inside the combustion chamber. Thus, less heat is required to produce steam inside the combustion chamber, and more heat energy is available for driving the steam to penetrate into the earth formation.

Diesel fuel is preferred for use in the generator; however, light crude oil can also be successfully used. Depending on which fuel is used, and whether air or another form of oxidant is used, the combustion products include various quantities of carbon dioxide, sulfur oxides, and nitrogen oxides. The acids formed when these products are combined with water can increase the porosity of the earth formation, enhance penetration of the steam and thus enhance flow rate of oil to a production well.

Another benefit derived from preheating the water is that preheated water exerts less of a cooling effect on the combustion flame and thereby reduces the tendency of soot formation and the attendant problems of air pollution and clogging of the pores of the earth formation.

Still other objects and advantages of the present invention will become readily apparent to those skilled in this art from the following detailed description, wherein I have shown and described only the preferred embodiment of the invention, simply by way of illustration of the best modes contemplated for carrying out the invention. As will be realized, the invention is capable of other and different embodiments and its several details are capable of modification in various, obvious respects, all without departing from the invention. Accordingly, the drawings and description are to be regarded as illustrative in nature, and not as restrictive.

BRIEF DESCRIPTION OF THE DRAWING

The accompanying drawings, which are incorporated in and form a part of this specification, illustrate several aspects of the present invention, and, together with the description, serve to explain the principles of the invention. In the drawings.

DETAILED DESCRIPTION OF THE INVENTION

Figure 1:
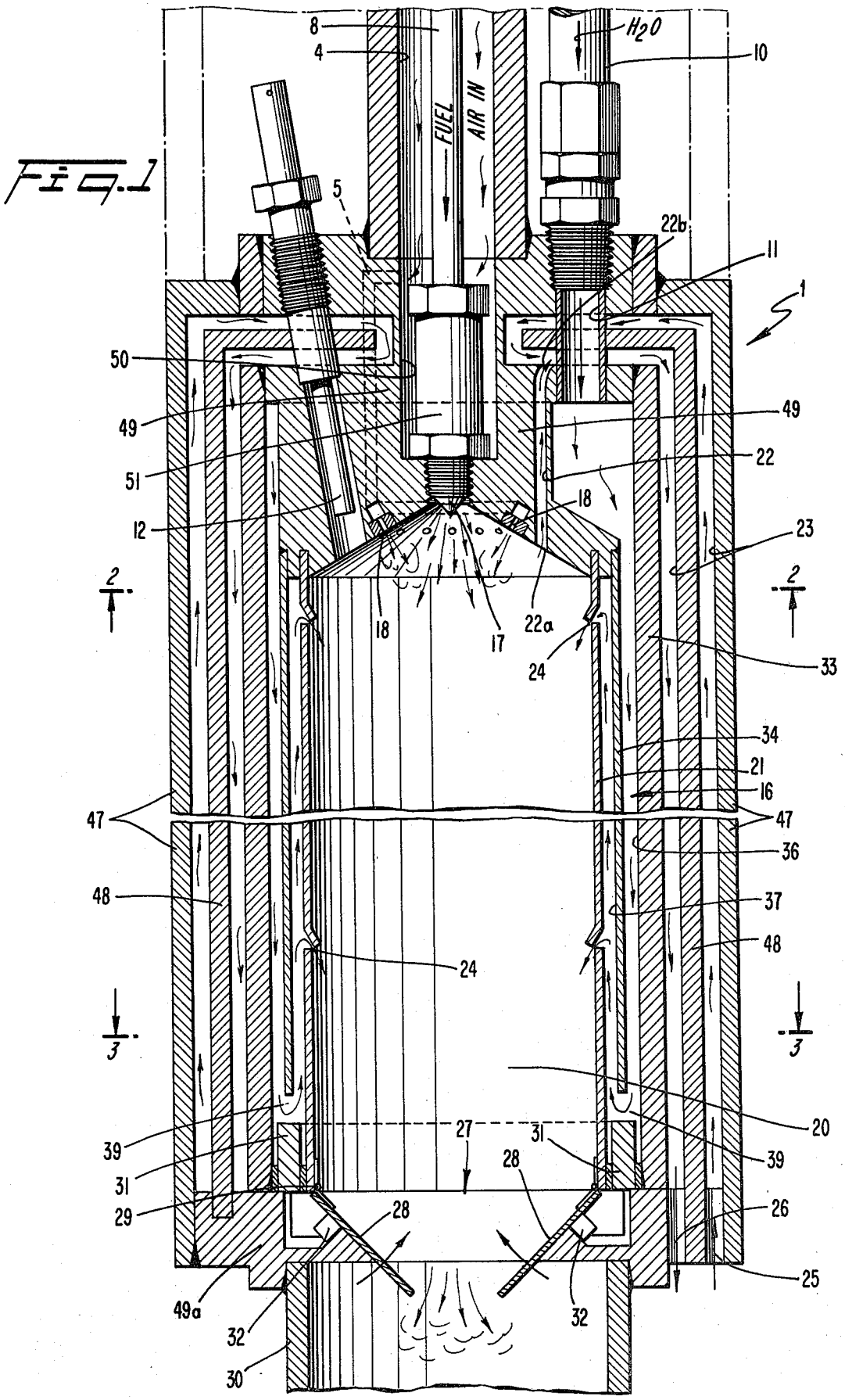
FIG. 1 is a longitudinal cross-sectional view partially broken away illustrating a downhole steam generator of the invention.

With reference to FIG. 1, in accordance with the invention, the apparatus 1 for generation of steam in a borehole for penetration into an earth formation comprises: an oxidant supply line 4; a fuel supply line 8 for supplying fuel which is combusted when mixed with the oxidant; and ignitor 12, such as a glow plug for igniting the fuel and oxidant mixture; a water supply line 10 with entry tube 11 for providing water to be converted to steam by the heat of combustion of the fuel/oxidant; and a combustor assembly 16.

Figure 2:
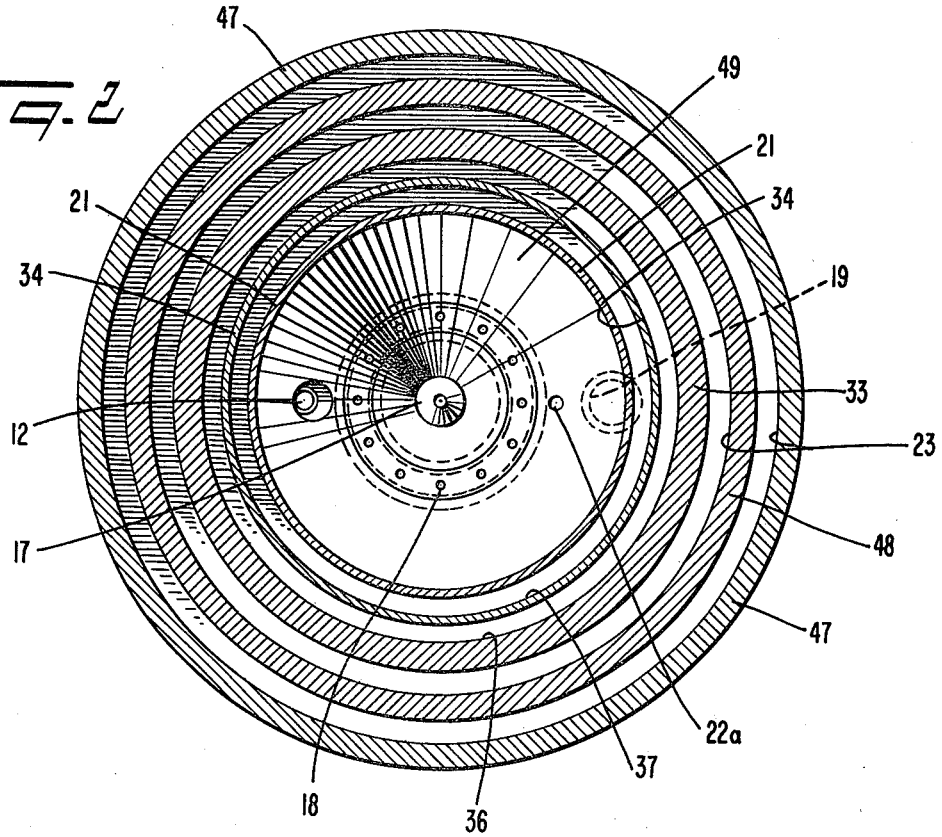
FIG. 2 is a lateral cross-sectional view of the steam generator taken along lines 2—2 of FIG. 1.

The combustor assembly 16 has a fuel injector nozzle 17, a plurality of oxidant inlet nozzles 18 (see FIG. 2 also), a combustion chamber 20, slotted water inlets 24 positioned along combustion chamber wall 21, and a steam outlet 27. A first hot gas feedback conduit 22 with entry port 22*a* connects the upper portion of the combustion chamber 20 with a heat transfer location for the line 8 (see FIG. 1). In particular, the hot combustion gases from the combustion chamber 20 are carried to the location in top cap 49 in proximity to the fuel supply fitting 51 for preheating the fuel.

Figure 3:
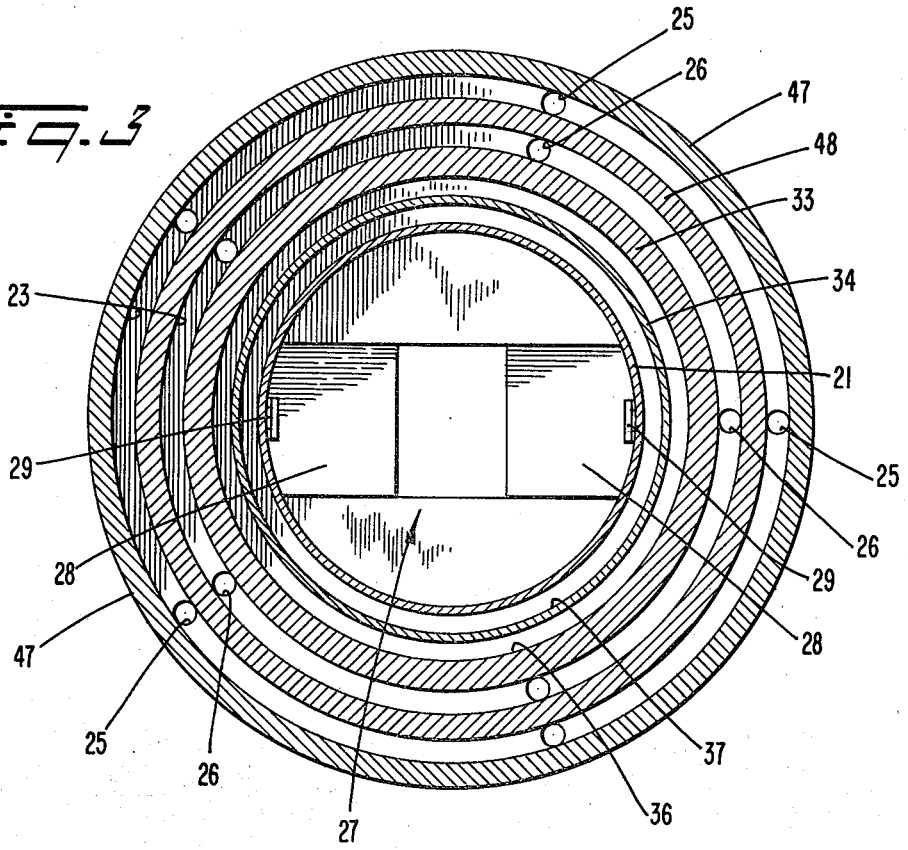
FIG. 3 is a lateral cross-sectional view taken along lines 3—3 of FIG. 1.

In accordance with another aspect of the invention, a second feedback conduit 23 connects the lower borehole and the heat transfer location in top cap 49. Hot gases and steam from the lower borehole adjacent the steam outlet 27 enter a plurality of spaced inlets 25 (see FIG. 3), and pass through the full loop of the annular conduit 23. The feedback conduits 22,23 merge in the top cap 49 adjacent the fuel heat transfer location to effectively conduct heat to fitting 51 of fuel line 8. At the same time incoming in line 4 is preheated in the gap around the fitting 51. After transferring heat, the borehole gases and steam exhaust through spaced outlet ports 25 (see FIG. 3) back to the lower borehole. The feedback conduit 23 is formed by the two outer housing sleeves 47, 48, the top cap 49 (see FIGS. 1 and 2) and bottom cap 49*a* (see FIGS. 1 and 3).

The high pressure combustion gases in conduit 22 are injected into the exit leg of the conduit 23 at an angled exit port 22*b*. This injection toward the outlet port 26 creates a positive flow through the conduit 23 and insures a constant flow of heat transfer fluid.

In accordance with another aspect of the invention, the downhole steam generator is provided with pressure responsive doors 28 capable of closing or opening steam outlet 27 in response to the pressure sensed within the combustion chamber 20. Preferably, doors 28 (see FIGS. 1 and 3) are provided with hinges 29 for easy opening and closing. As best shown in FIG. 1, a nozzle shroud 30 may be provided to protect the doors 28 from bumping against rock formations or other obstacles. In a simple case, the doors may be urged closed by mechanical springs or, preferably, doors 28 are more closely controlled by an electromechanical door actuators 32 whose operation is in turn controlled by electronic diagnostic/control module 31, as will be seen more in detail below during the discussion of FIG. 4.

Preferably, the combustor assembly of the invention further includes a cylindrical outer housing sleeve 33, a cylindrical inner sleeve 34, spaced between and concentric with respect to both the outer sleeve 33 and the combustion chamber wall 21. The annular space between the outer sleeve 33 and the inner sleeve 34 is connected to the water supply 10 and defines a first flow channel 36. The annular space between the inner sleeve 34 and the combustion chamber wall 21 defines a second flow channel 37. A passage 39, defined by the lower edge of inner sleeve 34 interconnects the first and second water flow channels 36 and 37 adjacent the bottom of the generator. Thereby, downward and upward flow or counterflow of water through channels 36 and 37 cools the combustion chamber wall 21, and, in addition, preheats the water in a countercurrent manner prior to entry into the combustion chamber 20 for conversion into steam. The annular conduit 23 with the flow of hot combustion gases and steam inside is particularly efficient in transferring preheat energy to the downward annular channel 36 (see FIG. 1). The countercurrent flow of water also advantageously serves to maintain the temperature of module 31 at a controlled level.

The more efficiently preheated water allows less heat of combustion to be drained off for heating the water and thus allows more heat energy to be available for generating high enthalpy steam and driving the steam into the earth formation. As the preheated water enters combustion chamber 20 through downwardly directed slots 24 in combustion chamber wall 21, the fluid boundary layer adjacent to wall 21 is stirred up and made highly unstable. As a result, the thickness of the boundary layer is reduced considerably, and the velocity of its swirling movement is increased. The boundary layer of decreased thickness and increased velocity results in more efficient stripping of the water entering the combustion zone from the wall 21, and thus a better mixing of the fluids. A much enhanced ability to generate high enthalpy steam results. In addition to this optimization of the vaporization process, the combustion chamber wall 21 remains cool and thus the thermal stress is minimized.

Figure 4:
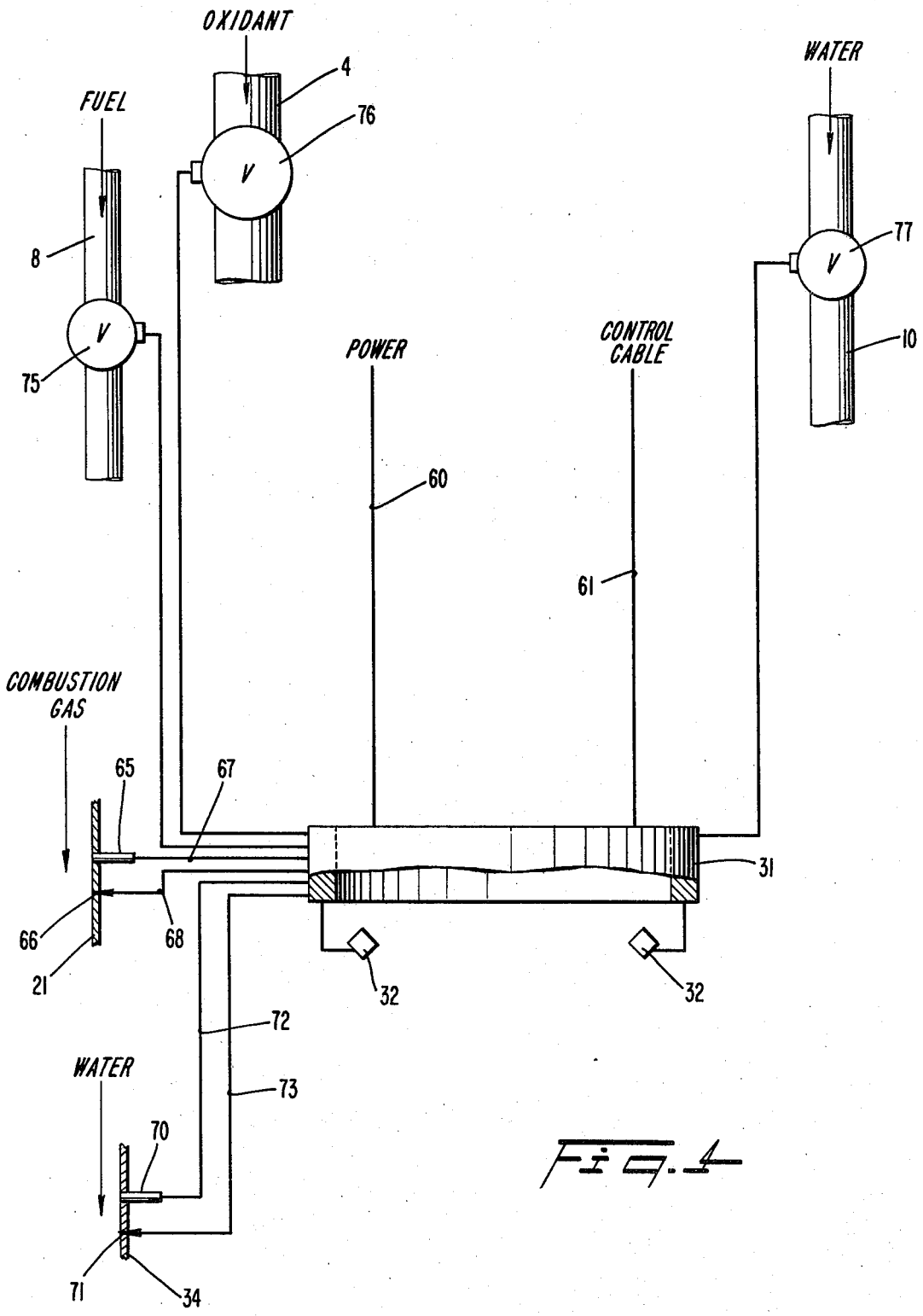
FIG. 4 is a schematic diagram of the diagnostic/control system for the generator.

With reference now to FIG. 4, the diagnostic/control system of the steam generator of the present invention can be described in more detail. The heart of the system is the self-contained electronic module 31 housed in a water-tight jacket and positioned adjacent the bottom of the generator within the water flow channels 36,37, and particularly at the connecting flow passage 39 (See FIG. 1). With this concept, the self-contained module can be positioned in the downhole steam generator and maintained at a carefully controlled working temperature. The module 31 is preferably constructed of microelectronic components and eliminates the need for above-ground computers.

The module 31 receives power from cable 60 and can also be provided with control cables 61 to the above-ground control site for the steam generator. It will be understood that these cables 60,61 are grouped with the delivery string of the generator. The output signals from the control cable 61 can be used for readout of the various functions of the steam generator and can also be utilized to provide manual input or correction of functions as required.

As briefly described above, the actuators 32 for the doors 28 are controlled by the module 31. These actuators can be of any selected electromechanical devices that are available. Preferably, the actuators 32 are designed to be connected to the doors 28 by extendable linkage and are capable of varying the position between the fully open position (see FIG. 1) and the closed position. Thus, the actuators 32 can close the doors 28 when a flameout occurs in order to protect the combustion chamber, but also the actuators 32 can be utilized through analog control by the module 31 to regulate the opening at the nozzle outlet 27. This regulation can provide better control of the combustion due to maintaining the most efficient operating pressure and temperature within the combustion chamber 20 regardless of the conditions in the borehole or variations in the supply of the fluids to the generator.

In order to sense the condition of combustion within the combustion chamber 20, suitable pressure and temperature transducers 65,66, respectively, are provided on the combustion chamber wall 21 (see FIg. 4). The pressure transducer 65 can be any suitable high pressure measuring device available commercially, and the temperature transducer 66 can be a simple thermocouple. The signals are provided to the module 31 through lines 67,68, respectively. With these parameters being monitored in the combustion chamber 20, the electronics in the module 31 can diagnose any problem, provide output signals to make necessary adjustments to correct the problem and at the same time provide a signal through control cables 61 indicating to the operator above ground the action being taken.

Similarly, the water temperature in the flow channels 36,37 can be monitored by pressure and temperature transducers 70,71, respectively, positioned in inner sleeve 34 (see FIG. 4). The signals, as before, are transmitted to the module 31 over suitable control lines 72,73. Of course, additional parameters and different locations can be monitored in the generator as desired depending on the degree of diagnosis and control of the operation of the generator 1 that is desired.

When the module 31 senses a variation in the combustion process, or in the flow of the cooling water, regulation of the supplies of fuel, oxidant and water can be effected. A control valve 75 in the fuel line 8 is designed to regulate the flow of fuel in the event that the module 31 determines that this is desired. Simiarly, a valve 76 regulates the flow of oxidant entering through the oxidant supply line 4 and the valve 77 regulates the cooling and steam generating water entering through the water supply line 10. As shown, each of these valves 75–77 is connected through a suitable control line (not numbered) with the module 31.

In operation of the steam generator 1 of the present invention, the results and advantages of the various aspects of the invention should now be apparent. The water entering the supply line 10 flows through the counterflow channels 36,37 where the water is preheated and cools the combustion chamber wall 21 at the same time and is ejected through the slotted inlets 24 into the combustion chamber 20. Fuel from the nozzle 17 is sprayed into the top of the combustion chamber 20 surrounded by oxidant orifices 18 positioned in a concentric arrangement. The glow plug 12 ignites the mixture and turns the water into high enthalpy steam ejected from the nozzle outlet 27 at the bottom of the generator 1. The doors 28 are opened and regulated by the actuators 32 in order to optimize the combustion process.

The preheating function of the water and the fuel is carried out in a unique manner. The feedback conduits 22,23, merge at a location in the top cap 49. The fuel is heated in the supply fitting 51 at a location directly adjacent the merging point. The hot combustion gases flowing through the conduit 22 and the steam and other hot gases flowing from the borehole through the conduit 23 provide a highly efficient preheater for the fuel. As an incident to this preheating function, the oxidant in the supply line 4 is also heated as it flows around the fitting 51. The incoming water from supply line 10 as it travels through entry tube 11 and then through downward channel 36 is efficiently heated by this preheater arrangement.

As the water is ejected through the thermally directed slotted inlets 24, it has been preheated to substantially a boiling point and is ready to be quickly converted to steam in the combustion chamber 20. The boundary layer along the combustion chamber wall 21 is maintained in an unstable condition so that the stripping of any water occurring along the wall is accomplished. A thorough mixing and swirling of hot gaseous fluids and the water and water vapor is optimized. At the same time the thermal stress on the wall 21 is minimized since the walls are kept cool by the regulated flow of water through the channels 36,37.

In the event that a flameout or loss of combustion occurs, the doors 28 are immediately closed sealing the combustion chamber 20 from the fluid within the borehole. Furthermore, under the control of the diagnostic/control module 31, the doors may be modulated in order to maintain the desired temperature and pressure within the combustion chamber 20.

Also during the operation the control module 31 regulates the supply of fluids, namely fuel, oxidant and water in order to maintain the optimum operating conditions. The control signals to provide this function can be taken from transducers within the combustion chamber, the water channels or other locations. Most importantly, the diagnostic/control module 31 is protected in the downhole environment by mounting within the water flow channels 36,37 where the temperature of the sensitive electronics can be closely controlled.

Thus, in summary, it will now be realized that the downhole steam generator 1 of the present invention provides substantial results and advantages over prior art devices. Substantially more efficient preheating of the fuel and water is accomplished by the feedback heating conduits 22,23. The counterflow water through the channels 36,37 allows the preheating water function to occur and at the same time maintains a constant, relatively cool temperature for the combustion chamber wall 21 in order to relieve the thermal stresses that would otherwise occur. At the same time, the control module 31 is advantageously cooled by the flow of water in the channels 36,37.

The combustion chamber 20 of the combustor of the invention is designed with the downwardly directed slotted inlets 24 and the flow rate of the water is so regulated so as to provide an unstable boundary layer along the combustion chamber wall 21. This assures an enhanced mixing of the hot gases with the water entering the chamber to be converted into steam and a continuous stripping action of water from the wall 21, as desired.

The foregoing description of the preferred embodiment of the apparatus of the invention has been provided for purposes of illustration and description. It is not intended to be exhaustive or to limit the invention to the precise form disclosed. Obvious modifications and variations are possible in light of the above teaching.

The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An apparatus for generating steam in a borehole comprising a combustor assembly which comprises a combustion chamber, top cap header means attached to an upper end thereof and steam and hot gas outlet means at the lower end thereof; oxidant inlet means, fuel inlet means and igniter means in communication with said combustion chamber through said top cap header means for generating hot combustion gas; water inlet means in communication with said combustion chamber to provide steam upon contact with said hot gas; and a hot gas feedback conduit extending from the combustion chamber to a preheat location in said top cap header means in the proximity of said fuel inlet means for preheating the fuel.

2. The steam generation apparatus of claim 1 wherein a portion of said water inlet means is located adjacent said hot gas feedback conduit for preheating said water.

3. The steam generation apparatus of claim 1 wherein said water inlet means comprises slotted inlets in the wall of the combustion chamber for injection of the water for steam generation.

4. The steam generation apparatus of claim 1 and including a combination steam and hot gas feedback conduit extending from below said steam and hot gas outlet means to said preheat location for enhancement of fuel preheating.

5. The steam generation apparatus of claim 4 wherein the hot gas feedback conduit is connected to said combination steam and hot gas feedback conduit to enhance circulation of the steam and hot gas therethrough.

6. The steam generation apparatus of claim 5 wherein said feedback conduits merge adjacent said preheat location.

7. The steam generation apparatus of claim 6 wherein said hot gas feedback conduit merges at an angle to said combustion steam and hot gas feedback conduit to drive said hot gas and steam.

8. An apparatus for generation of steam in a borehole for penetration into an earth formation, comprising:

an oxidant supply means;

a fuel supply means for supplying fuel;

an ignitor means for igniting the fuel and oxidant mixture;

a water supply means for providing water to be converted to steam by the heat of combustion;

a combustor assembly having fuel inlet means, oxidant inlet means, a combustion chamber defined by a chamber wall for generating hot combustion gas, water inlet means to provide steam upon contact with the hot gas and steam outlet means; and a cylindrical outer housing sleeve, a cylindrical inner sleeve spaced between and concentric with respect to both said outer sleeve and the wall defining said combustion chamber, the space between said outer sleeve and said inner sleeve connected to said water supply means and defining a first annular water flow channel, the space between said inner sleeve and said combustion chamber wall connected to said water inlet means and defining a second annular water flow channel, and passage means interconnecting said first and second flow channels, whereby downward and upward flow of water through said channels cools said combustion chamber and preheats the water in a countercurrent manner.

9. The steam generation apparatus of claim 8 wherein is provided a hot gas and steam feedback conduit from the borehole below said steam outlet means to a preheat location adjacent said fuel supply means for conveying hot combustion gases and steam from the borehole for preheating the fuel, said feedback conduit extending concentrically along the length of said generator and positioned adjacent said first annular water flow channel for enhanced preheating of said water.

10. The steam generation apparatus of claim 8 wherein said chamber wall is provided with a plurality of spaced downwardly directed slotted inlets for injecting the water into said combustion chamber, the injection of the water being such as to provide an unstable boundary layer along the wall and stripping of water for efficient steam generation.

11. An apparatus for generation of steam in a borehole comprising an oxidant supply means;

a fuel supply means for supplying fuel;

an igniter means for igniting the fuel and oxidant mixture;

a water supply means for providing water to be converted to steam by the heat of combustion;

a combustor assembly having fuel inlet means, oxidant inlet means, a combustion chamber for generating hot combustion gases, water inlet means to provide steam upon contact with the hot gas, steam outlet means, and door means operably connected to the steam outlet means;

a control module comprising pressure and temperature transducer means for sensing parameters in said generator connected to said control module; and actuator means responsive to said control module to control the operation of said generator said actuator means being operably connected to said door means for adjusting the position of said door means responsive to the combustion chamber pressure.

12. The steam generation apparatus of claim 11 wherein is provided valve means on at least one of said supply means and said actuator means is provided on at least one of said valve means to control the flow of fluid to said generator.

13. An apparatus for generation of steam in a borehole comprising an oxidant supply means;

a fuel supply means for supplying fuel;

an igniter means for igniting the fuel and oxidant mixture;

a water supply means for providing water to be converted to steam by the heat of combustion;

a combustor assembly having fuel inlet means, oxidant inlet means, a combustion chamber for generating hot combustion gases, water inlet means to provide steam upon contact with the hot gas and steam outlet means; and door means operably connected to said steam outlet means and including a control module, transducer means in communication with said combustion chamber for sensing the pressure in said chamber, said transducer means being operably connected to the control module and including actuator means responsive to said control module to control the position of said door responsive to the combustion chamber pressure for the purpose of optimizing combustion in said chamber and for preventing a backflow of liquid from the borehole when the pressure in said chamber is too low.

* * * * *